US007922443B2

(12) United States Patent
Yuasa

(10) Patent No.: US 7,922,443 B2
(45) Date of Patent: Apr. 12, 2011

(54) PORTABLE AIR BLOWER

(75) Inventor: Tsuneyoshi Yuasa, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 659 days.

(21) Appl. No.: 11/670,665

(22) Filed: Feb. 2, 2007

(65) Prior Publication Data

US 2008/0184523 A1 Aug. 7, 2008

(51) Int. Cl.
*F04D 29/70* (2006.01)

(52) U.S. Cl. ..... 415/121.2; 415/126; 416/247 R; 417/423.9

(58) Field of Classification Search ..... 415/121.2, 415/126, 206; 416/247 R; 417/423.9; 15/405, 15/422

See application file for complete search history.

(56) References Cited

U.S. PATENT DOCUMENTS

| | | | | |
|---|---|---|---|---|
| 2,005,408 | A * | 6/1935 | Allin | 415/121.2 |
| 5,233,946 | A | 8/1993 | Yamami | |
| 6,059,541 | A * | 5/2000 | Beckey et al. | 417/295 |
| 6,629,818 | B2 * | 10/2003 | Svoboda | 415/121.1 |
| 7,300,484 | B2 * | 11/2007 | Scully et al. | 55/385.1 |
| 7,476,091 | B2 * | 1/2009 | Saitou et al. | 417/423.1 |

* cited by examiner

*Primary Examiner* — Edward Look
*Assistant Examiner* — Ryan H Ellis

(57) ABSTRACT

A portable air blower includes a blower fan, a drive unit for driving the blower fan, a casing for covering at least the blower fan and having a side wall with an air intake opening defined therein, and a covering unit for covering the air intake opening. The covering includes an air intake grille fitted to the casing and operable to permit an air to pass therethrough into the air intake opening, but to block foreign matters off therefrom, and a protective shroud held in overlapping relation with the air intake grille for covering the air intake grille on one side of the air intake grille opposite to the air intake opening. The air intake grille has an outermost area having a circumferential edge, which is positioned substantially radially inwardly of an outer peripheral edge of the protective shroud.

20 Claims, 10 Drawing Sheets

PORTABLE AIR BLOWER

BACKGROUND OF THE INVENTION

1. Field of the Invention

The present invention relates to a portable blower utilizable mainly in cleaning works.

2. Description of the Prior Art

In parks and athletic fields, apt to be drifted with fallen leaves and/or rubbishes, a portable blower such as disclosed in, for example, U.S. Pat. No. 5,233,946, patented Aug. 10, 1993, has hitherto been used to scrape or sweep up those fallen leaves and/or rubbishes by the effect of an air stream emerging from an air blow nozzle thereby to enhance the cleaning efficiency. As shown in FIG. 10 of the accompanying drawings, such a portable blower includes a casing 81 accommodating a blower fan and a combustion engine as a drive unit to drive the blower fan, both not shown, and having an air intake opening 82, defined in a side wall of the casing 81, and an air blast opening 85. The air intake opening 82 is covered with a covering member or grille 83, which is generally a net-like or grid-like cover, and an air blow nozzle 86 is fluidly connected with the air blast opening 85.

The portable blower 80 of the structure described above is carried by an attendant worker with his or her hand holding a handle 87 provided at an upper region of the casing 81 so that the air blow nozzle 86 may be directed to scattering fallen leaves and/or rubbishes to enable those fallen leaves and/or rubbishes to be scraped or sweet up to one or more piles thereof by the effect of an air stream emerging from a tip opening 86*a* of the air blow nozzle 86. The pile or piles of the fallen leaves and/or rubbishes are subsequently packed into garbage bags or directly into a garbage car.

During the cleaning work with the portable air blower 80 of the structure described above, it is quite often that since the air intake grille 83 is positioned laterally of the worker's leg, a clothing, particularly one of the trousers of the attendant worker may contact the air intake grille 83. Once the trouser contacts the air intake grille 83, then drawing an air stream therethrough into the interior of the blower 80 by way of the air intake opening 82, the air intake grille 83 is blocked off with the air stream failing consequently to be smoothly sucked through the air intake opening 82.

SUMMARY OF THE INVENTION

In view of the foregoing, the present invention has been devised to substantially eliminate the problems and inconveniences inherent in the prior art portable air blower of a kind discussed above and is intended to provide an improved portable air blower, in which an air stream can be smoothly sucked without the perforated covering unit being blocked off during the cleaning work.

In order to accomplish the foregoing object of the present invention, there is provided, in accordance with the present invention, a portable air blower including a blower fan for producing an air current, a drive unit for driving the blower fan, a casing for covering at least the blower fan and having a side wall with an air intake opening defined therein, and a covering unit for covering the air intake opening. The covering unit in turn includes an air intake grille fitted to the casing and operable to permit an air to pass therethrough into the air intake opening, but to block foreign matters, and a protective shroud held in overlapping relation with the air intake grille for covering the air intake grille on one side of the air intake grille opposite to the air intake opening. The air intake grille includes a base held in contact with the casing and an outermost area substantially opposite to the base, which outermost area is positioned spaced a distance from a plane of the base with a circumferential edge of the outermost area positioned substantially radially inwardly of an outer peripheral edge of the protective shroud.

It is to be noted that the term "foreign matter" used hereinabove and hereinafter is intended to mean solid matter of a kind which, when sucked into the portable air blower, may give rise to a damage to the blower fan. Such solid matter may include fallen leaves and/or soft and rubbishes.

According to the present invention, since an outer region of the air intake grille is covered by the protective shroud, the attendant worker commissioned to do a cleaning job with the portable air blower in hand can be prevented from contacting the air intake grille directly. Since the outermost area of the air intake grille held in contact with the protective shroud has the circumferential edge positioned at location closer to the center of the air intake opening than the peripheral edge of the protective shroud, it is avoided that a part of his or her clothing is sucked from the peripheral edge of the protective shroud to a peripheral surface portion of the air intake grille enough to clog the peripheral surface portion thereof. Accordingly, air can be smoothly introduced into the air intake opening through the air intake grille and, hence, an abrupt increase of the number of revolutions of the combustion engine, which would result from an abrupt decrease of the amount of air being sucked (i.e., an abrupt decrease of a load on the combustion engine) can be suppressed advantageously to allow the durability of the combustion engine E to increase.

The protective shroud referred to above preferably has front and rear portions which protrude substantially radially outwardly from the air intake grille, when viewed in a lateral direction. As can readily be understood by those skilled in the art, the attendant worker walks back and forth while carrying the air blower during the cleaning work and, at this time a clothing of the attendant worker such as, for example, at least one of his or her trousers moves relative to the air blower. However, since the protective shroud, when viewed in the lateral direction, ie, a direction towards an outer major surface thereof, has front and rear portions protruded substantially radially outwardly from the contour of the air intake grille, with front and rear portions of the air intake grille consequently covered by the protective shroud completely, an undesirable sucking of that portion of the clothing of the attendant worker can be effectively prevented.

In a preferred embodiment of the present invention, the protective shroud, when viewed in the lateral direction, has a vertical length and a longitudinal length, the vertical length being smaller than the longitudinal length. As hereinbefore discussed, when the attendant worker walks back and forth while carrying the air blower 1 during the cleaning work, clothing of the attendant worker undergoes a relative movement back and forth, departing from the protective shroud, but a similar relative movement in a vertical direction is minimal. Accordingly, by rendering the protective shroud to be so sized as to have a relatively small length in the vertical direction, an undesirable increase of the size of the protective shroud can be avoided advantageously, making it possible to manufacture the protective shroud and eventually the air blower with a reduced weight.

In another preferred embodiment of the present invention, the air blower may be provided with a hinged support structure for supporting the air intake grille for pivotal movement between a protecting position, in which the air intake grille is in position to cover the air intake opening in the casing, and an open position, in which the air intake grille is clear of the air intake opening, and a fastener for locking the air intake grille in the protecting position. In this case, when the air intake grille is pivoted about a pivot axis defined in the hinged support structure, the air intake opening defined in the casing can be covered by the air intake grilled or opened to the outside and, accordingly, when the air intake opening is opened, the blower fan can be easily serviced during the maintenance.

The protective shroud has front and rear portions opposite to each other and a center portion substantially intermediate between the front and rear portions and, when viewed from top, is preferably smoothly depressed at the center portion in a direction inwardly of the front and rear portions thereof. Since the center portion of the protective shroud is depressed inwardly of the front and rear portions thereof, a relatively large space can be secured between the front and rear portions of the protective shroud and the casing, allowing a sufficient amount of air to be smoothly guided into the air intake opening through such space. Also, the depressed configuration of the protective shroud allows the protective shroud to fit to one of the legs of the attendant worker and, therefore, the attendant worker will not feel uncomfortable.

Also, the air intake grille is preferably of a shape to converge from the base thereof towards the outermost area. According to this preferred embodiment, the outermost area of the air intake grille can be minimized to allow the gap between this outermost area and the peripheral edge of the protective shroud to be large, and, therefore, an undesirable sucking of a part of the closing to the air intake grille can be effectively suppressed.

In a further preferred embodiment of the present invention, the air intake grille and the protective shroud may be respective members separate from each other, in which case the protective shroud is removably connected with the air intake grille through a plurality of engagement pawls. The engagement pawls are useful in facilitating a connection between the air intake grille and the protective shroud. The protective shroud may alternatively be connected with the air intake grille in overlapping relation therewith by means of a screw connection, which ensures a firm connection therebetween. Thus, the use of the air intake grille and the protective shroud that are members separate from each other is particularly advantageous in that in the event of occurrence of any damage to one of the air intake grille and the protective shroud, only such one of the air intake grille and the protective shroud can be replaced with a new one. Also, where the user of the air blower does not like to have the protective shroud affixed to the air intake grille, the air blower can be used with the protective shroud removed from the air blower.

Alternatively, the air intake grille and the protective shroud may be formed integrally with each other. This can be accomplished by the use of any known plastic molding technique. As a matter of course, integral formation of the air intake grille with the protective shroud does in effect reduce the number of component parts used to assemble the air blower.

In a still further preferred embodiment of the present invention, the protective shroud may have a peripheral edge area having a chamfered portion formed on an outer surface of the peripheral edge area, the chamfered portion being inclined inwardly towards the outer peripheral edge of the protective shroud. According to this preferred embodiment, even when a portion of the body of the attendant worker contacts the peripheral edge area of the protective shroud, the presence of the chamfered edge portion prevents the worker from feeling uncomfortable.

The present invention in accordance with another aspect thereof also provides a portable air blower which includes a blower fan, a drive unit for driving the blower fan, a casing for covering at least the blower fan and having a side wall with an air intake opening defined therein, an air intake grille for covering the air intake opening and having a base, which is held in contact with the casing, and an outermost area substantially opposite to the base, and a protective shroud fitted to an outer area of the air intake grille and having front and rear portions opposite to each other and a center portion substantially intermediate between the front and rear portions. The air intake grille used therein is of a shape to converge from the base thereof towards the outermost area with the outermost area positioned spaced a distance from a plane of the base, and the protective shroud, when viewed from top is smoothly depressed at the center portion in a direction inwardly of the front and rear portions thereof.

According to the second aspect of the present invention, as mentioned above, the possibility can be avoided that the clothing of the attendant worker may clog the air intake grille, the air can be smoothly introduced from the air intake grille into the air intake opening.

The outermost area of the air intake grille may preferably have a flat vertex wall and may be held in coaxial relation with a center of the air intake opening and the protective shroud has a boss held in contact with the flat wall of the air intake grille. With this preferred feature, the protective shroud can be stably supported by the air intake grille through the flat wall of the air intake grille and the boss in the protective shroud cooperating with such flat wall.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described in detail with reference to the accompanying drawings.

Figure 1:
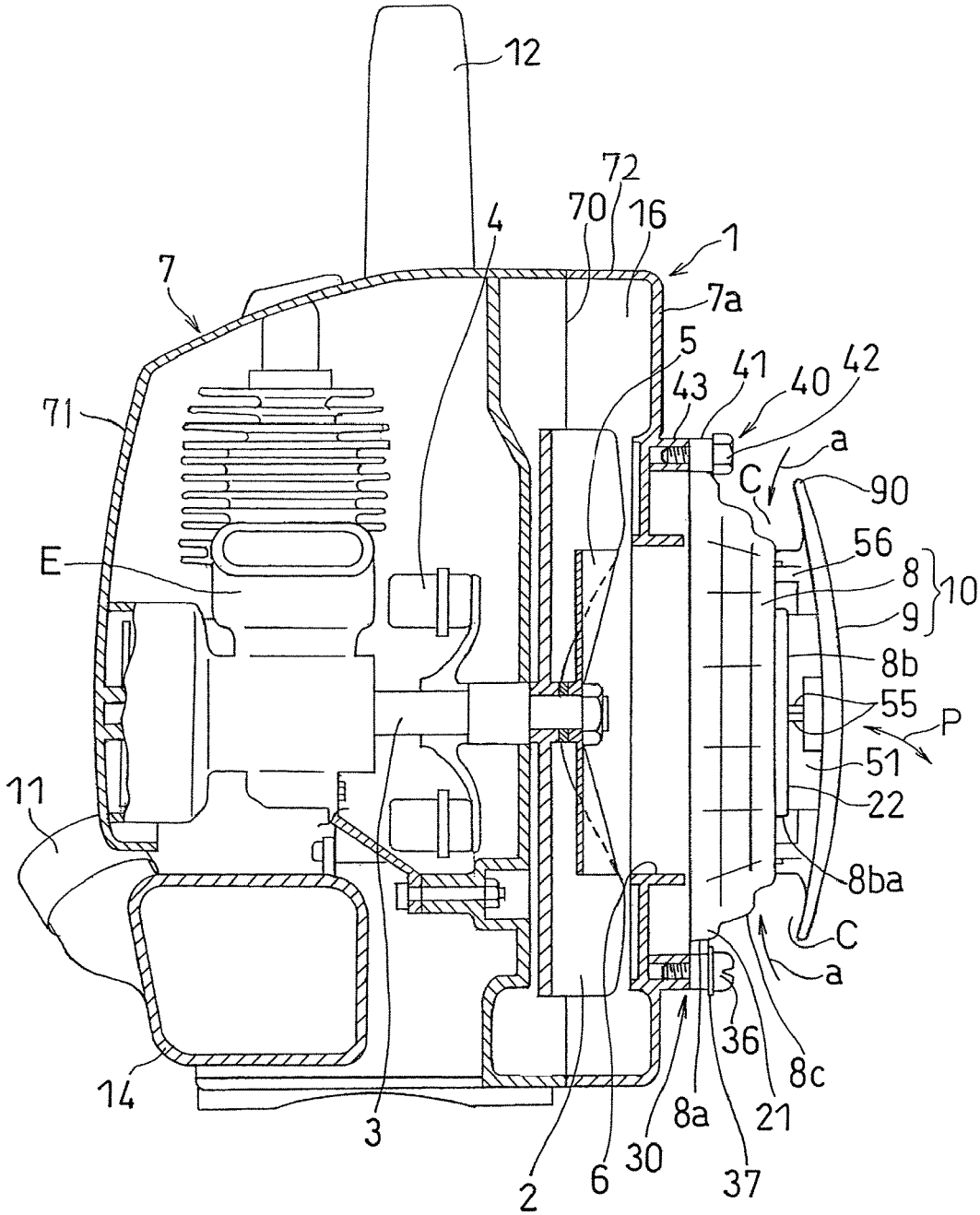
FIG. 1 is a transverse sectional view illustrating a main portion of a portable air blower according to a preferred embodiment of the present invention, which blower is viewed from front.

Referring to FIG. 1 showing a portable air blower according to a first preferred embodiment of the present invention, the illustrated portable air blower, generally identified by 1, is of a type, in which an impeller or a blower fan 2 is driven in one direction by a drive unit, specifically a manually startable combustion engine E to produce an air current. This combustion engine E has a crankshaft 3, on which a cooling fan 4 for cooling the engine E, a blower fan 2 positioned on one side of the cooling fan 4 opposite to the engine E, and a rotary cutter 5 positioned on one side of the blower fan 2 opposite to the cooling fan 4 are mounted for rotation together therewith. The combustion engine E and the blower fan 2 are accommodated within and, therefore, covered by a casing 7 having an outer side wall 7*a* formed with an air intake opening 6, through which air is drawn inwardly of the casing 7 from the outside of the air blower 1.

It is also to be noted that the casing 7 may be of a design covering only the blower fan 2, leaving the combustion engine E open to the outside. The air intake opening 6 referred to above is covered by a covering unit 10.

The casing 7 so far as employed in the practice of the present invention is of a two-piece construction made up of an engine casing portion 71 and a blower fan casing portion 72, which are positioned on respective side of a plane of joint 70 and are separable from each other. A fuel tank 14 for accommodating a quantity of fuel for the combustion engine E and having a fuel tank cap 11 for closing a fuel refilling port of the fuel tank 14 are positioned in a lower region of the combustion engine E, and a carrying handle 12 is fixedly mounted, or otherwise formed integrally with, an upper region of the casing 7.

Figure 2:
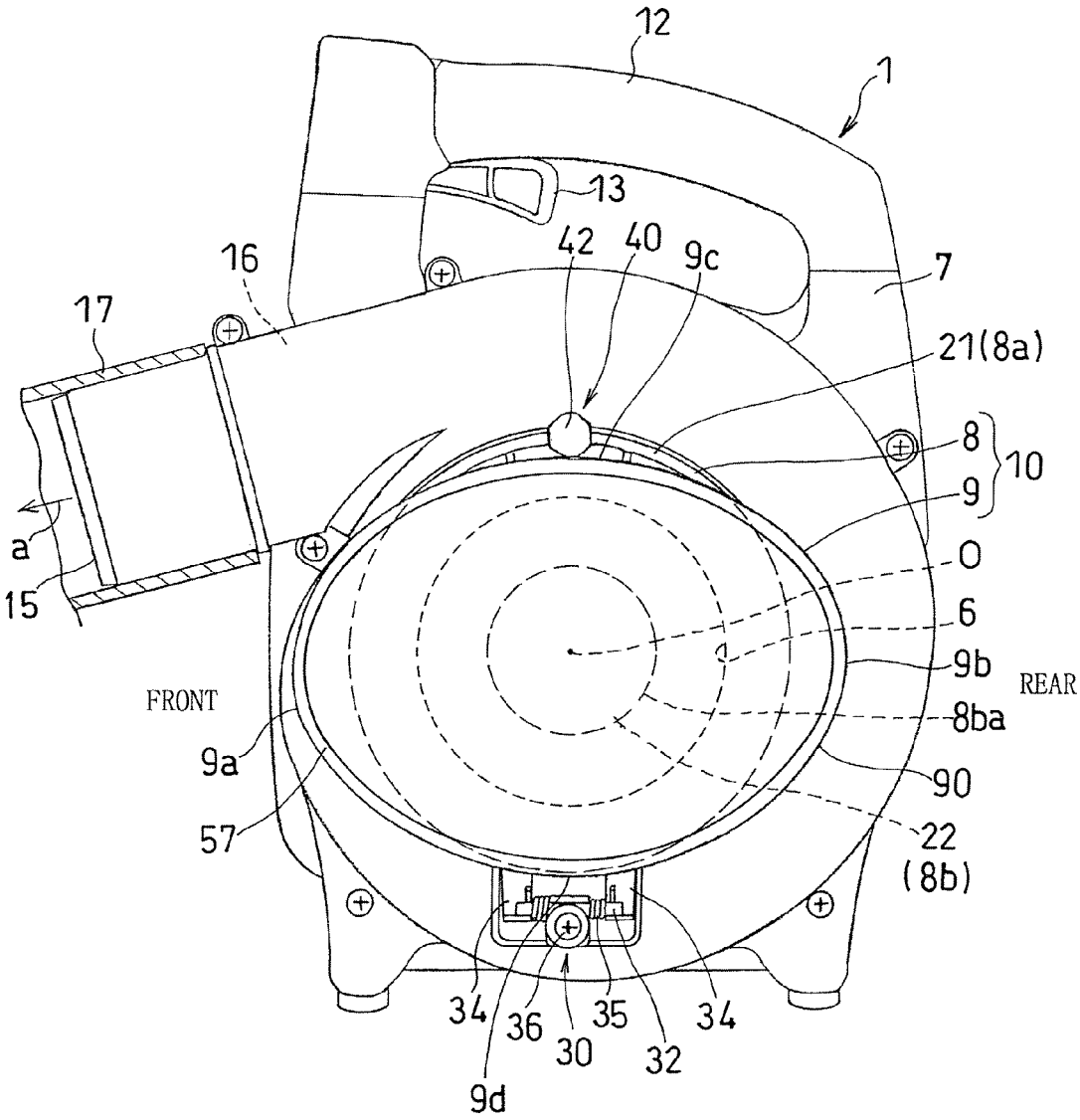
FIG. 2 is a side view of the main portion of the air blower.
Figure 10:
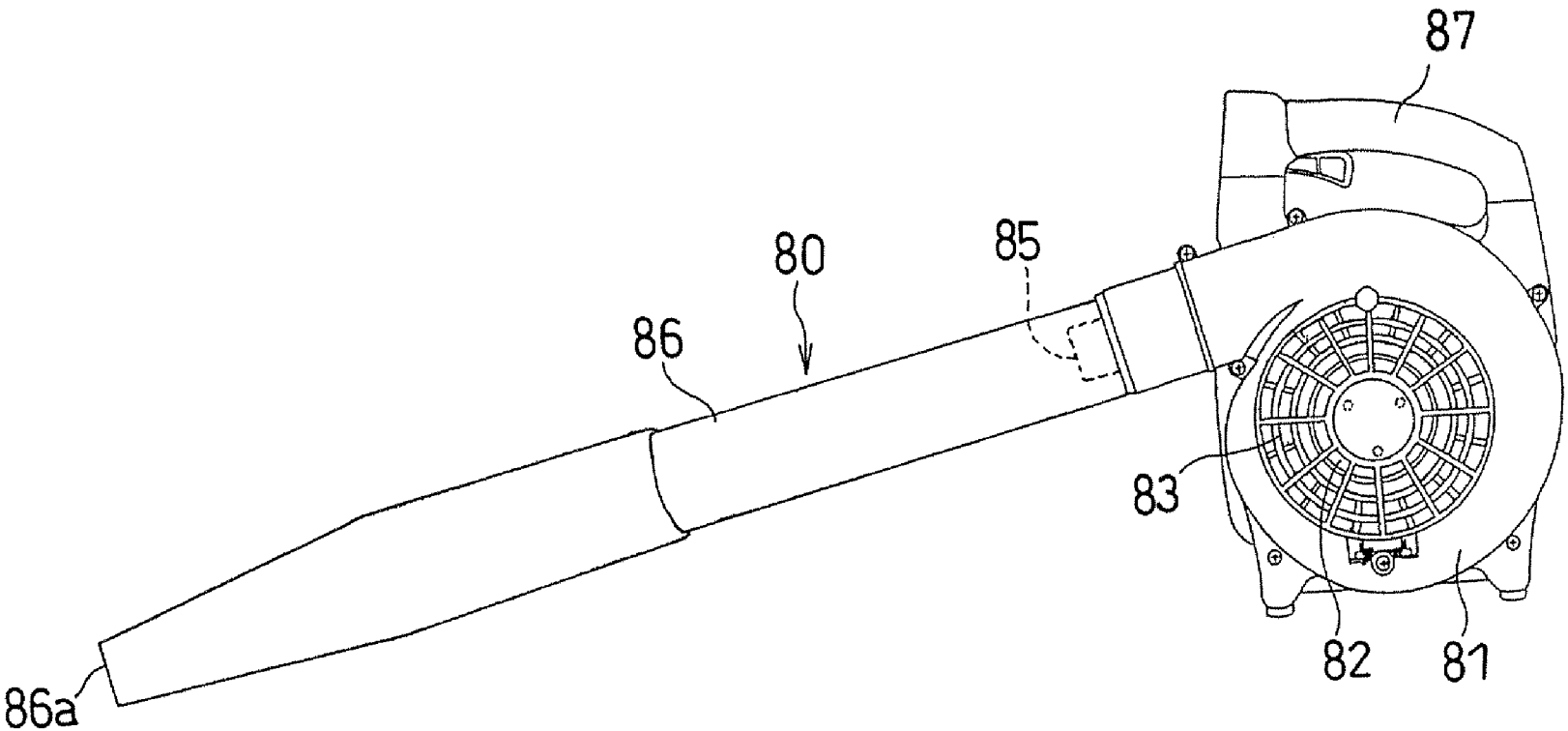
FIG. 10 is a side view of the prior art portable air blower.

As best shown in FIG. 2, showing a side view of the air blower 1, a throttle control lever 13 for controlling the number of revolutions of the combustion engine E and, hence, the blast volume is positioned beneath the carrying handle 12. The casing 7 has a blast opening 15 defined in a front portion thereof, and an air blow nozzle 17 in the form of a generally elongated tube similar to that identified by 86 in FIG. 10 is fluidly coupled with the blast opening 15 in a removable manner well known to those skilled in the art. Thus, air sucked from the air intake opening 6 by the fan 2 then being driven can be guided towards the blast opening 15 through an air guide passage 16, defined within the casing 7.

The covering unit 10 includes, as shown in FIG. 1, a perforated covering, for example, an air intake grille 8, which may be substantially round in shape (see FIG. 2), and a protective shroud 9, which may be substantially oval in shape (see FIG. 2) and is positioned on one side of the air intake grille 8 opposite to the air intake opening 6. The air intake grille 8 is fitted to the casing 7 and serves to prevent foreign matters from being sucked into the air intake opening 6, but to allow air to be sucked from the outside into the air intake opening 6. On the other hand, the protective shroud 9 positioned outside the air intake grille 8 with respect to the air intake opening 6 serves to prevent the air intake grille 8 from being blocked off by, for example, the attendant worker's trouser or any other clothing. Both of the air intake grille 8 and the protective shroud 9 are made of a synthetic resin by the use of any known molding technique.

The air intake grille 8 has a round base 8*a* fitted to the casing 7 and an outermost area 8*b* positioned spaced a distance from a plane of the base 8*a*. The base 8*a* and the outermost area 8*b* are disposed in alignment with the air intake opening 6. The air intake grille 8 is of a shape to converge from the base 8*a* thereof towards the outermost area 8*b*. In the illustrated instance, the air intake grille 8 is convexed in a stepped fashion to represent the generally conical configuration convexed outwardly and terminating at the outermost area 8*b*. With the protective shroud 9 fitted to the air intake grille 8 in a manner as will be described later, a communicating space C communicating to the air intake opening 6 is defined between the protective shroud 9 and the outer side wall 7*a* of the casing 7.

Figure 3:
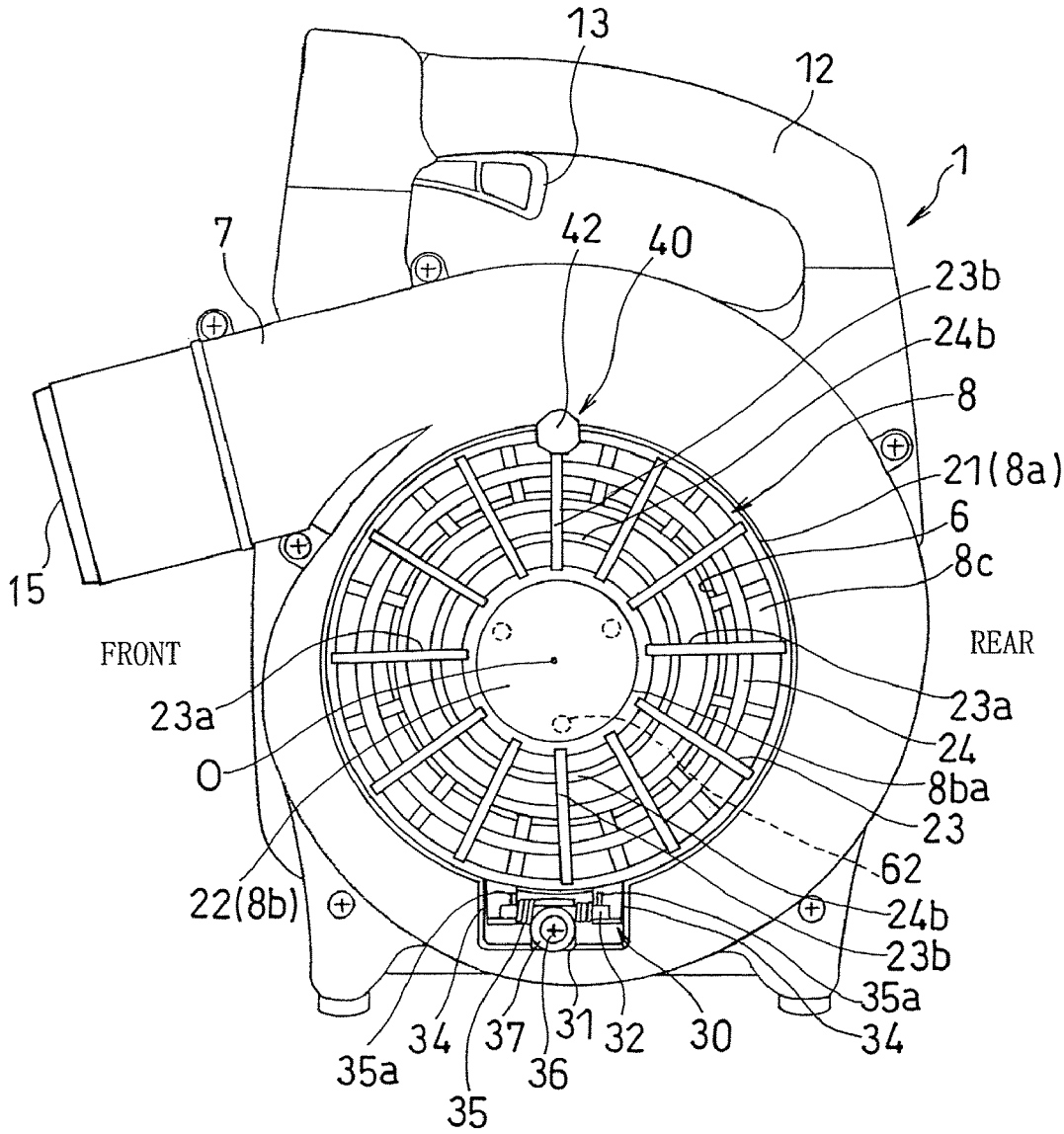
FIG. 3 is a view similar to FIG. 2, showing the main portion of the air blower with a protective shroud thereof removed.

The base 8*a* of the air intake grille 8 is in the form of a ring 21 as clearly shown in FIG. 3 showing the air blower 1 with the protective shroud 9 removed, whereas the outermost area 8*b* thereof is defined by a round flat vertex wall 22 of a diameter smaller than that of the base 8*a*. Referring to FIGS. 1, 2 and 3, with the protective shroud 9 fitted to the casing 7 through the air intake grille 8, the ring 21 and the vertex wall 22 are held in a coaxial relation with a center O of the air intake opening 6. These ring 21 and vertex wall 22 are connected together through a plurality of radially and coaxially extending ribs 23 and 24 with its peripheral area 8*c* perforated in a fashion similar to a net or grid, thereby completing the air intake grille 8. Foreign matters such as, for example, fallen leaves and/or rubbishes can be blocked off by this air intake grille 8 during the use of the portable air blower 1 and will not therefore enter the air intake opening 6.

The air intake grille 8 is supported by the casing 7 in a manner, which will now be described, for pivotal movement between a protecting position, in which the air intake grille 8, together with the protective shroud 9, is in position to cover the air intake opening 6, and an open position, in which the air intake opening 6 is uncovered and is hence left open to the outside, by means of a pivotally connecting structure, specifically a hinged support structure 30. This air intake grille 8 is, when in the protecting position, locked in the protecting position relative to the casing 7 to cover the air intake opening 6 by means of a fastener 40 as will be described later.

As best shown in FIG. 3, the hinged support structure 30 is of a design capable of exerting a biasing force so as to urge the air intake grille 8 towards the protecting position at all times and, for this purpose, includes a pin carrier 31 formed on the casing 7, a pin 32 supported thereby, and a coiled or torsional spring 35. The air intake grille 8 is provided with front and rear brackets 34 and 34, each having a semicircular pit 33 (FIG. 4), and is pivotally supported with opposite end portions of the pin 32 inserted in the respective pits 33 in the front and rear brackets 34 and 34. The torsional spring 35 referred to above has radially outwardly extending free ends 35*a* and 35*a* opposite to each other and is so mounted around the pin 32 with the radially extending free ends 35*a* and 35*a* engaged to respective outer side faces of the brackets 34 and 34 so that the torsional spring 35 can apply a biasing force to the air intake grille 8 to urge the latter towards the protecting position.

It is to be noted that the pin 32 supported by the pin carrier 31 is fixed in position on the pin carrier 31 by means of a set screw 36 threaded into the pin carrier 31 through a pin washer 37 so as to avoid separation of the pin 32 from the pin carrier 31.

Thus, it will readily be seen that the air intake grille 8 is pivotable between the protecting and open positions about the pin 32 and is normally biased by the torsion spring 35 to the casing 7 so as to assume the protecting position.

The fastener 40 positioned at the top of the air intake grille 8 includes, as best shown in FIG. 1, a boss 41 formed on the air intake grille 8, an externally threaded fastening element 42 such as, for example, a screw and an internally threaded boss 43 formed on the casing 7 for threading engagement with the fastening element 42. Thus, when the air intake grille 8 is pivoted to or held in the protecting position and the screw 42 is subsequently turned to engage in the internally threaded boss 43 through the boss 41 of the air intake grille 8, the latter 8 can be locked in the protecting position relative to the casing 7 to cover the air intake opening 6.

On the other hand, when the fastening element 42 is loosened and the air intake grille 8 is subsequently pulled to pivot from the protecting position about the pin 32 against the biasing force of the torsional spring 35 shown in FIG. 3, the air intake grille 8 can be moved to the open position to open the air intake opening 6 in FIG. 1 to the outside. With the air intake grille 8 held in the open position in the manner described above, the air intake opening 6 can be utilized not only as an open area that permits an access to the blower fan 2 for inspection or any other handy maintenance servicing, but also as a suction port through which a pile of fallen leaves and/or rubbishes can be sucked into a garbage bag as will be described later.

Figure 4:
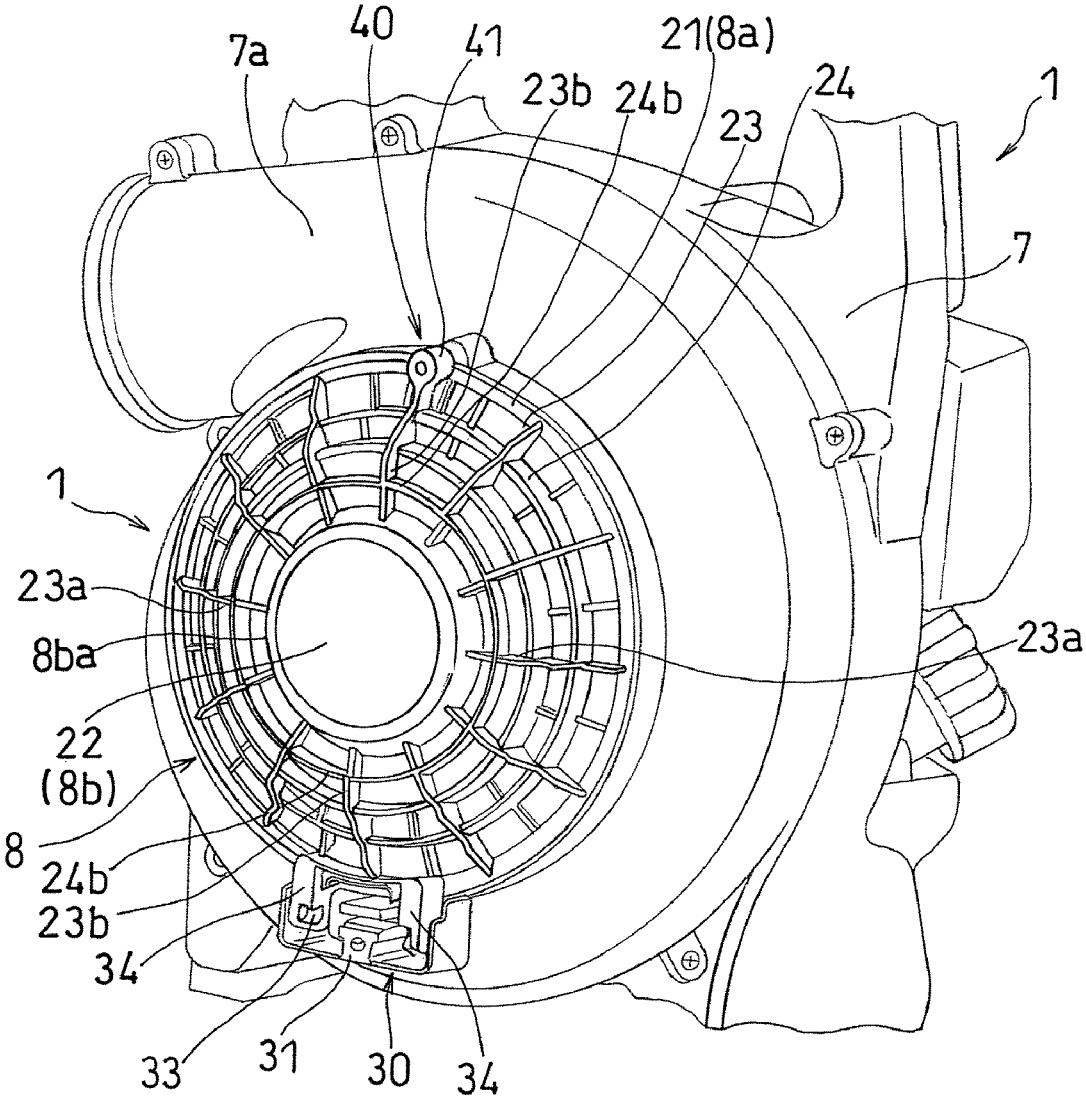
FIG. 4 is a perspective view of the main portion of the air blower with the protective shroud thereof removed.

It is to be noted that in FIG. 4, the pin 32, torsional spring 35, set screw 36 and pin washer 37, all forming respective part of the hinged support structure 30, and the fastening element 42 of the fastener 40 are not shown for the sake of brevity.

Referring to FIG. 2, the air intake grille 8 and the protective shroud 9 are so sized relative to each other that a circumferential edge 8*ba* of the outermost area 8*b* of the air intake grille 8 is positioned inwardly of an outer peripheral edge 90 of the protective shroud 9 and substantially coaxial with the geometric center O of the air intake opening 6. In other words, the outermost area 8*b* of the air intake grille 8 is completely encompassed within and exteriorly covered by the protective shroud 9. The protective shroud 9 is, when viewed in a direction perpendicular thereto or in a lateral direction, so shaped as to represent a generally or substantially oval shape in which a vertical length between opposite upper and lower portions 9*c* and 9*d* of the outer peripheral edge 90 is smaller than a longitudinal length between similarly opposite front and rear portions 9*a* and 9*b* thereof and, at the same time, the front and rear portions 9*a* and 9*b* of the outer peripheral edge 90 protrude radially outwardly of the contour of the base 8*a* of the air intake grille 8.

Also, the upper portion 9*c* of the protective shroud 9 is positioned radially inwardly of an upper portion of the base 8*a* of the air intake grille 8 in order to allow the fastening element 42 of the fastener 40 to be exposed to the outside and the lower portion 9*d* of the protective shroud 9, which is opposite to the upper portion 9*c* thereof, is positioned substantially in level with a lower portion of the base 8*a* of the air intake grille 8.

Considering that the upper portion 9*c* of the protective shroud 9 is positioned radially inwardly of an upper portion of the base 8*a* of the air intake grille 8 as hereinabove described, the attendant worker can easily do or undo the fastening element 42. It is to be noted that the lower portion of the air intake grille 8 may protrude outwardly from the lower portion 9*d* of the protective shroud 9 by positioning the lower portion 9*d* of the protective shroud 9 radially inwardly of the lower portion of the base 8*a* of the air intake grille 8.

Figure 5:
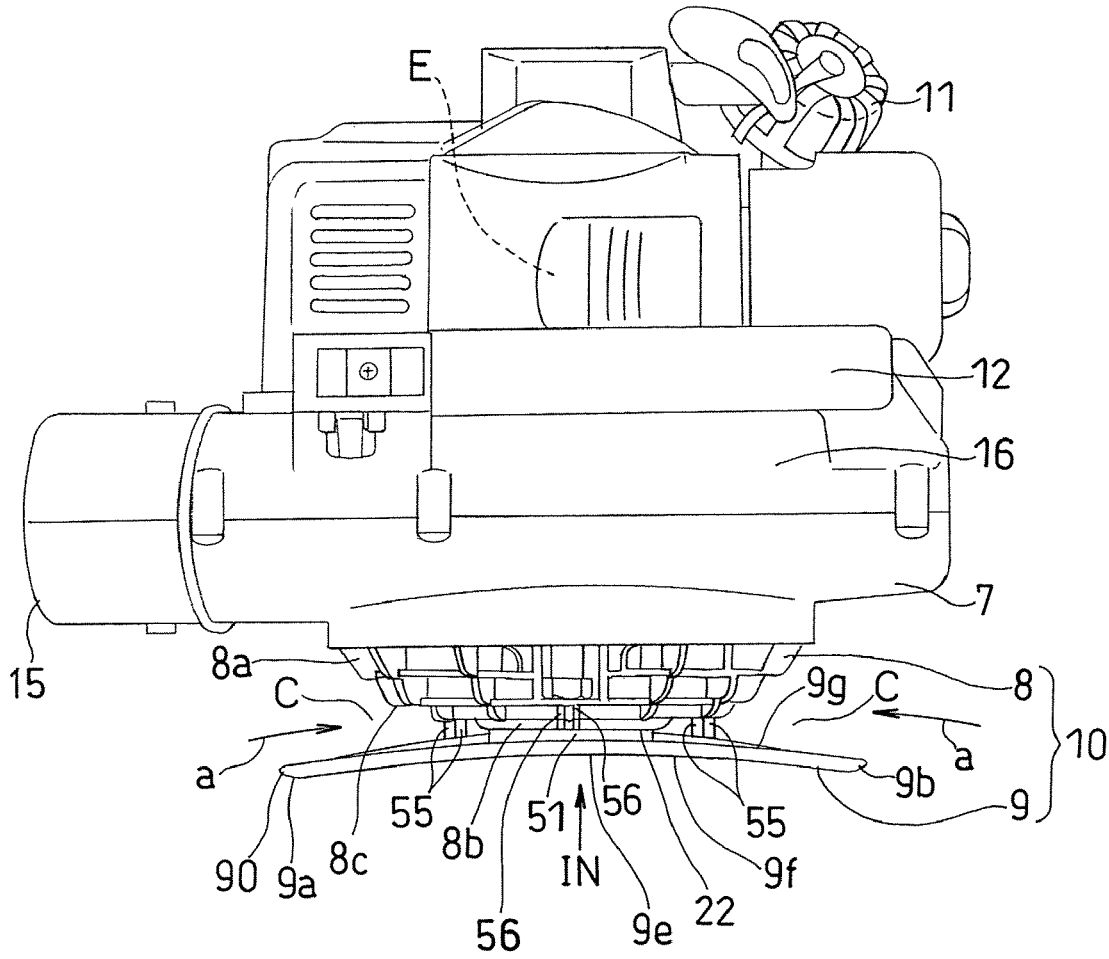
FIG. 5 is a top plan view of the main portion of the air blower.

As best shown in FIG. 5, a top plan view, the protective shroud 9 is of a thin plate having outer and inner major surfaces 9*f* and 9*g*, when viewed from top, that are smoothly curved with an intermediate portion 9*e* of the protective shroud 9 concaved relative to the front and rear portions 9*a* and 9*b* thereof in an inward direction, shown by the arrow IN, close towards the air intake grille 8.

Figure 6:
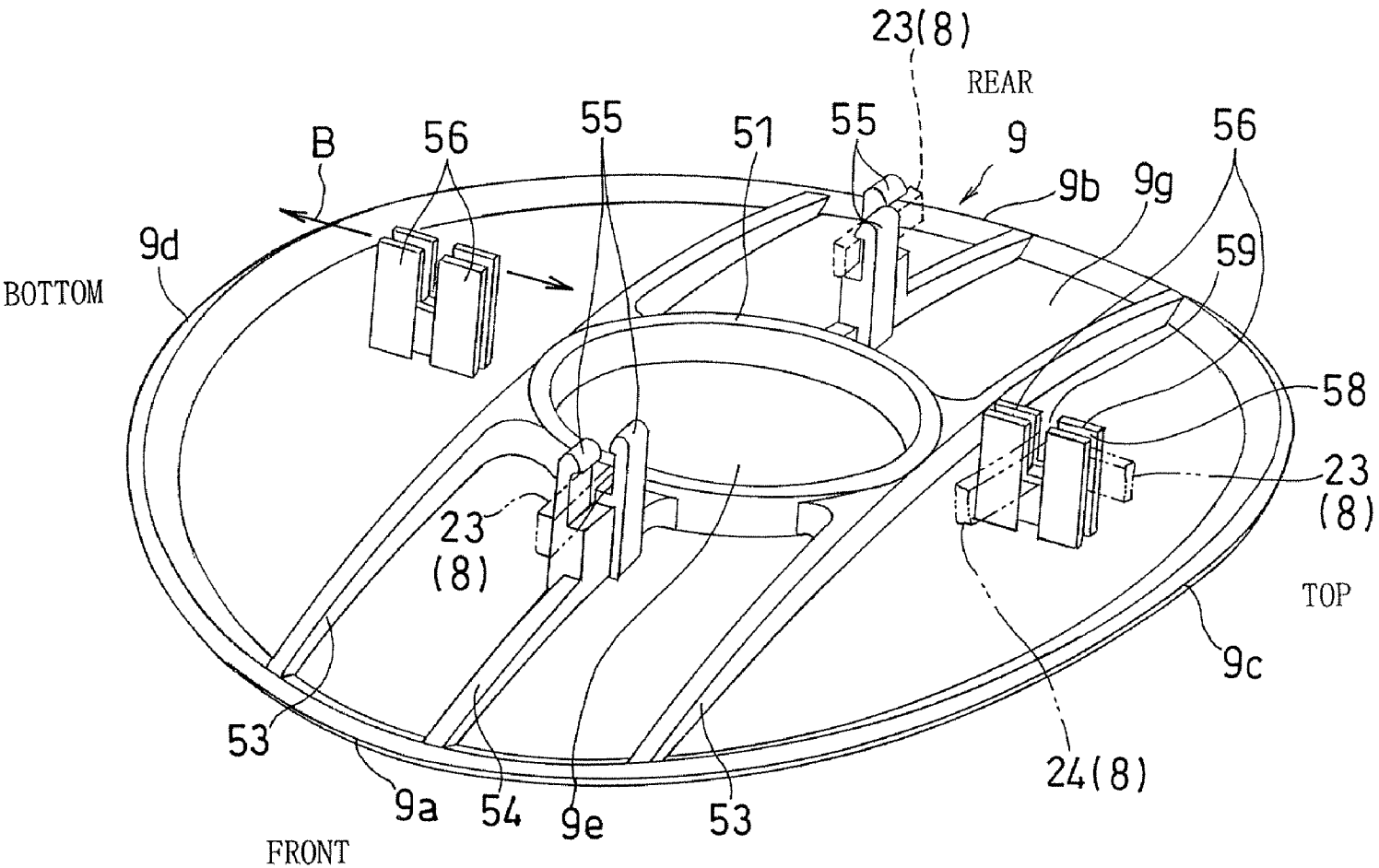
FIG. 6 is a perspective view showing an inner surface of the protective shroud of the air blower.

FIG. 6 illustrates features formed on the inner major surface 9*g* in a perspective representation. As shown therein, the inner major surface 9*g* of the protective shroud 9, or a surface confronting to the air intake grille 8, is formed with a ring-shaped boss 51 positioned at a center portion thereof, a pair of first parallel reinforcement ribs 53 and 53 positioned on respective sides of the ring shaped boss 51 and extending between the front and rear portions 9*a* and 9*b* in a direction tangential to the ring shaped boss 51, and second two-piece reinforcement rib 54 positioned intermediate between the first parallel reinforcement ribs 53 and 53, one piece extending between the ring shaped boss 51 and the front portion 9*a* and the other piece extending between the ring shaped boss 51 and the rear portion 9*b*.

Each piece of the second reinforcement rib 54 is provided with a pair of engagement pawls 55 and 55. Also, respective portions of the inner major surface 9*g* of the protective shroud 9 between the first reinforcement ribs 53 and 53 and each of the upper and lower portions 9*c* and 9*d*, are formed with respective pairs of guides 56 and 56.

Figure 7:
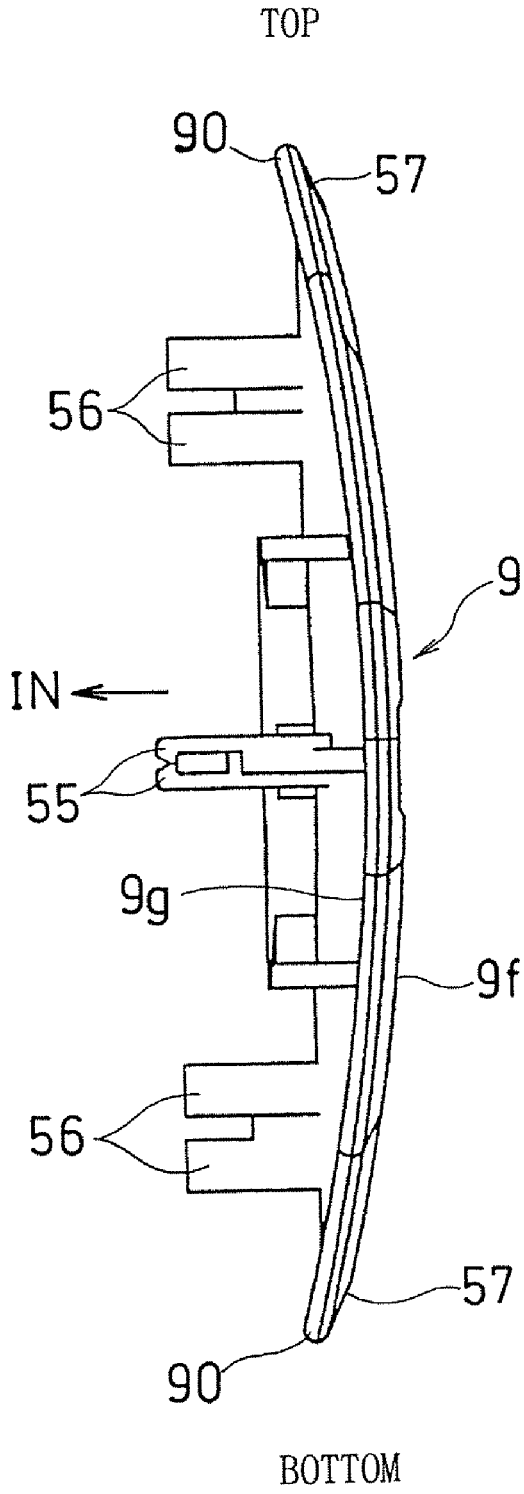
FIG. 7 is a front elevational view of the protective shroud of the air blower.

As shown in FIG. 7, an outer peripheral area of the outer major surface 9*f* or an area close to the outer peripheral edge 90 is provided over the entire circumference thereof with a chamfered portion 57 that is inclined in a direction towards the outer peripheral edge 90 and in the inward direction IN. This chamfered portion 57 is effective to allow the attendant worker to perform the cleaning job comfortably without feeling discomfort even when a portion of the body of the attendant worker contacts the outer peripheral edge 90 of the protective shroud 9.

Figure 8:
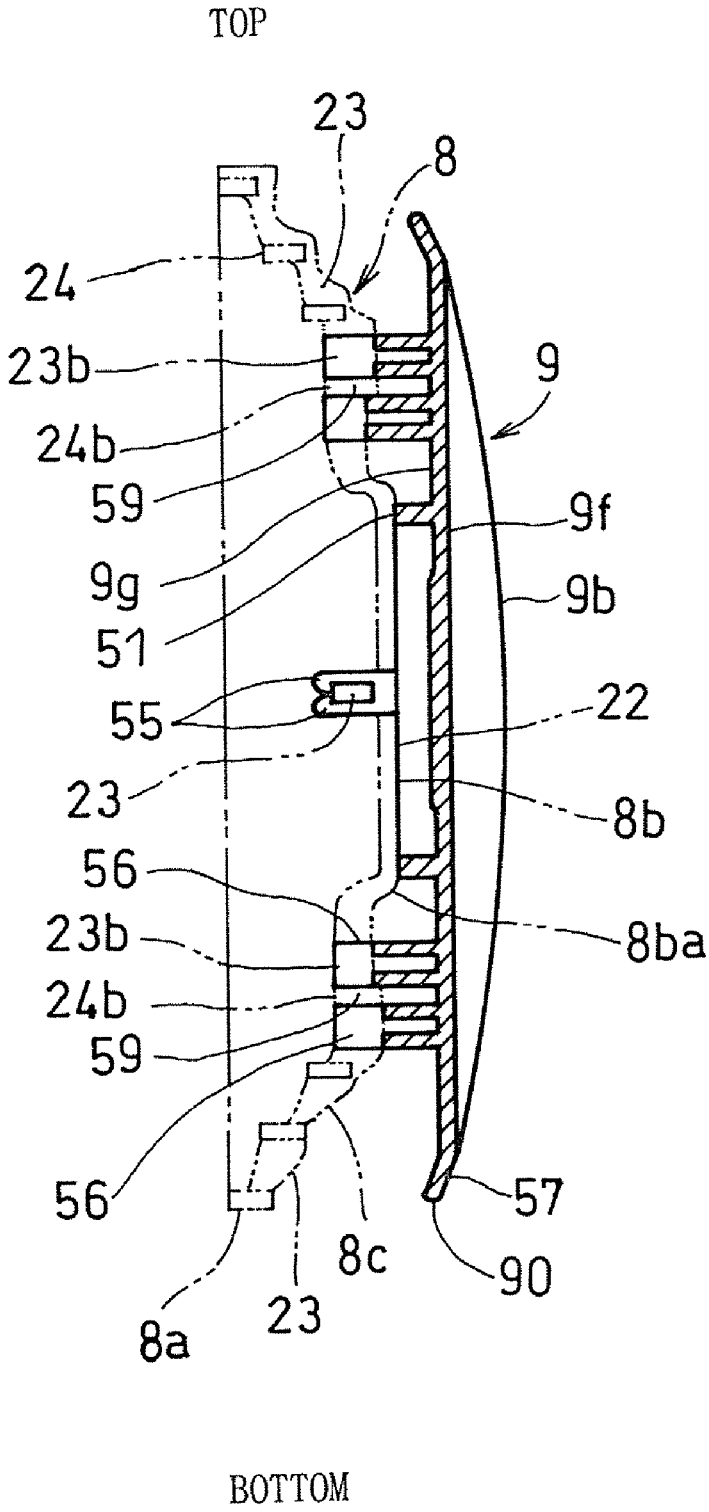
FIG. 8 is a transverse sectional view of the protective shroud shown in FIG. 7.

The protective shroud 9 of the structure hereinabove described is fitted to the air intake grille 8 in the manner which will now be described. The engagement pawls 55 and 55 shown in FIG. 6 are clipped onto respective engagement portions 23*a* (FIG. 3) of two of the radially extending ribs 23 of the air intake grille 8 and, at the same time, engagement portions 23*b* and 24*b* (FIG. 3) are engaged respectively in radial grooves 58 and circumferential groove 59, both formed in the guides 56 and 56. By so engaged, as shown in FIG. 8, the ring shaped boss 51 of the protective shroud 9 is brought into contact with the round vertex wall 22 of the air intake grille 8 to thereby complete fitting of the protective shroud 9 to the air intake grille 8. In such case, the engagement pawls 55 and 55 are clipped onto the radially extending ribs 23 so firmly that those engagement pawls 55 and 55 will not disengage from the radially extending ribs 23 unless an external pulling force is applied forcibly to the protective shroud 9, but the guides 56 and 56 merely serve to prevent the protective shroud 9 from rotating or shifting relative to the air intake grille 8 and are not therefore so strongly engaged to the air intake grille 8 as the engagement pawls 55 and 55.

In the construction hereinabove described, assuming that the attendant worker carries the portable air blower 1 of the present invention with his hand gripping the handle 12 at the top of the casing 7 shown in FIG. 2, while the air blower 1 is positioned beside one of his or her legs, and the air blow nozzle 17 fluid connected to the blast opening 15, the cleaning can be carried out with the air blow nozzle 17 directed towards fallen leaves and/or rubbishes scattering on a ground surface. The fan 2 shown in FIG. 1 induces a suction force with a current of air a drawn inwardly of the casing 7 through the air intake opening 6 by way of the communicating space C that is delimited between the casing 7 and the protective shroud 9. The air current a so sucked inwardly of the casing 7 is subsequently blasted to the outside of the casing 7 through the air guide passage 16 and then through the blast opening 15 by way of the air blow nozzle 17 and, accordingly, the fallen leaves and/or rubbishes can be swept up to one or more piles thereof by the effect of the air stream blasted from the air blow nozzle 17 for the convenience of cleaning.

During the operation of the portable air blower 1 of the present invention, a direct contact of the attendant worker, then carrying the air blower 1, to the air intake grille 8 can be avoided advantageously since the air intake grille 8 is covered by the protective shroud 9. Also, since the outermost area 8*b* of the air intake grille 8 held in contact with the protective shroud 9 has its outer circumferential edge positioned closer to the center O of the air intake opening 6 than the outer peripheral edge 90 of the protective shroud 9 shown in FIG. 2, it is avoided that a part of the clothing of the attendant worker is sucked via the outer peripheral edge 90 of the protective shroud 9 to the peripheral area 8*c* of the air intake grille 8 to clog such peripheral area 8*c*. Accordingly, as shown in FIG. 1, the stream of air a can be smoothly introduced from the air intake grille 8 into the air intake opening 6, so that an abrupt increase of the number of revolutions of the combustion engine E, which would result from an abrupt decrease of the amount of air being sucked, i.e., an abrupt decrease of a load on the combustion engine E can be suppressed advantageously to allow the durability of the combustion engine E to increase.

It is not infrequent that the attendant worker commissioned to sweep the fallen leaves and/or rubbishes walks back and forth while carrying the air blower 1 during the cleaning work and, at this time a clothing of the attendant worker such as, for example, at least one of his or her trousers moves relative to the air blower 1. However, since the protective shroud 9, when viewed in a lateral direction or in a direction towards the outer major surface 9*f* thereof as shown in FIG. 2, has front and rear portions 9*a* and 9*b* protruded substantially radially outwardly from the contour of the air intake grille 8, with front and rear portions of the air intake grille 8 consequently covered by the protective shroud 9 completely, an undesirable sucking of that portion of the clothing of the attendant worker can be effectively prevented.

The protective shroud 9 is so shaped that the vertical length or the maximum size measured along the minor axis of the oval shape is smaller than the longitudinal length or the maximum size measured along the major axis of the oval shape. On the other hand, although the clothing of the attendant worker undergoes a relative movement back and forth, departing from the protective shroud 9, when the attendant worker commissioned to sweep the fallen leaves and/or rubbishes walks back and forth while carrying the air blower 1 during the cleaning work as hereinabove described, a relative movement in the vertical direction is minimal. Accordingly, since the protective shroud 9 can be so sized as to have a relatively small size in the vertical direction, an undesirable increase of the size of the protective shroud 9 can be avoided advantageously, making it possible to manufacture the protective shroud 9 and eventually the air blower 1 with a reduced weight.

As best shown in and described with reference to FIG. 3, the air intake grille 8 is provided with the hinged support structure 30 for supporting the air intake grille 8 for pivotal movement between the protecting and open positions relative to the casing 7 and also with the fastener 40 for locking the air intake grille 8 in the protecting position. Accordingly, when the air intake grille 8 is pivoted about the point of pivot provided for by the hinged support structure 30 as shown by an arrow P (FIG. 1), the air intake grille 8 can be opened or closed relative to the casing 7 so that the fan 2 within the casing 8 shown in FIG. 1 can be easily serviced during the maintenance work.

As shown in and described with reference to FIG. 5, the protective shroud 9 is so smoothly curved, when viewed from top, as to have its center portion depressed relative to the front and rear portions 9*a* and 9*b* thereof. Accordingly, a relatively large space C is formed between the front and rear portions 9*a* and 9*b* of the protective shroud 9 and the casing 7, enough to allow the air a to be smoothly and sufficiently introduced into the air intake opening 6 shown in FIG. 1. Also, since the relatively inwardly depressed center portion of the protective shroud 9 can fit to one of the legs of the attendant worker, the attendant worker then carrying the air blower 1 will not feel discomfort.

Also, since the air intake grille 8 is of such a shape as to converge from the base 8*a* towards the outermost area 8*b* positioned spaced a distance from the plane of the base 8*a*, the outer diameter of the outermost area 8*b* of the air intake grille 8 is consequently reduced enough to have a large gap between the outermost area 8*b* and the outer peripheral edge 90 of the protective shroud 9 and, therefore, an undesirable sucking of the clothing to the air intake grille 8 can be effectively suppressed.

In addition, since the air intake grille 8 and the protective shroud 9 are members separate from each other and are coupled together through the engagement pawls 55 as shown in FIG. 8 and, therefore, the both can be separable whenever the necessity arises. Accordingly, the use of the air intake grille 8 and the protective shroud 9, that are separate from each other, is particularly advantageous in that in the event of occurrence of any damage to one of the air intake grille 8 and the protective shroud 9, such one of the air intake grille 8 and the protective shroud 9 can be replaced with a new one. The use of such separate intake grille 8 and the protective shroud 9 is also advantageous in that if the protective shroud 9 is removed, an air blower having no protective shroud, such as the known portable air blower shown in FIG. 10, can be available.

The portable air blower 1 shown in FIG. 1 can also be used as a vacuum cleaner, for example, after the fallen leaves and/or rubbishes have been piled up by the effect of the blast of air produced with the portable air blower 1. Specifically, after the portable air cleaner 1 is held in an inoperative position, the air intake grille 8, with the protective shroud 9 attached thereto, has to be pivoted to the open position with the fastener 42 loossened, to thereby allow the air intake opening 6 to be exposed to the outside. A generally or substantially tubular vacuum hopper (not shown) is subsequently connected to the air intake opening 6 and, on the other hand, the air blow nozzle 17 connected with the air blast opening 15 in FIG. 2 is replaced with a garbage bag (not shown) such as made of polypropylene. Thus, it will readily be seen that when the air blower 1 of the present invention is subsequently powered with the fan 3 driven, the fallen leaves and/or rubbishes forming a pile can be sucked into the garbage bag through the vacuum hopper and then through the air intake opening 6 after having been broken up into small pieces by the rotary cutter 5.

The air blower according to a second preferred embodiment of the present invention will now be described with reference to FIG. 9. In this second embodiment, the protective shroud, now identified by 9A, makes use of a screw connection to connect the air intake grille 8 and the protective shroud 9 together, in place of the engagement pawls 55 and 55 and their cooperative components which are employed in the practice of the previously described first embodiment.

Figure 9:
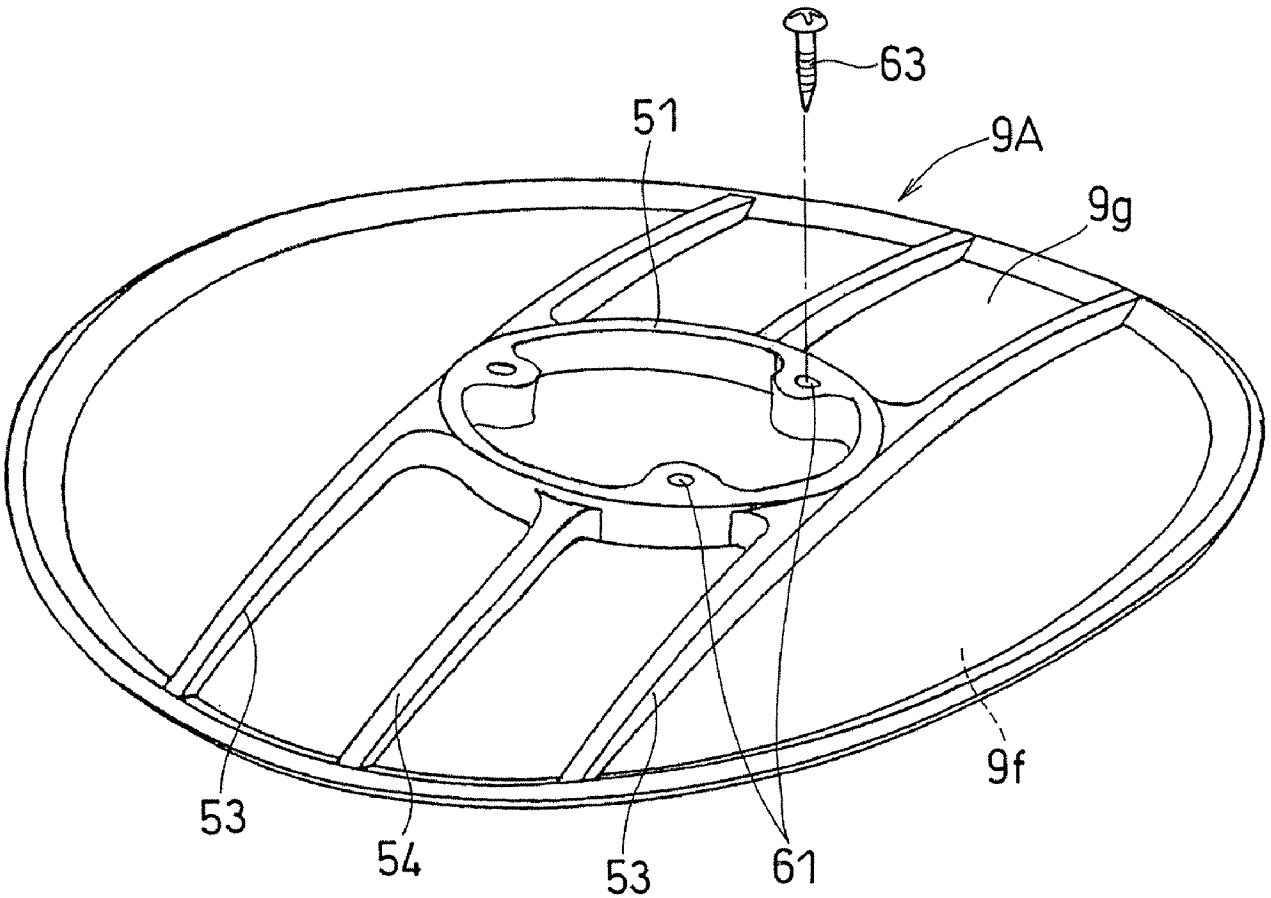
FIG. 9 is a perspective view of the inner surface of the protective shroud, which is designed in accordance with another preferred embodiment of the present invention.

Specifically referring now to FIG. 9, the ring shaped boss 51 formed on the rear surface 9*g* of the protective shroud 9A is formed with a plurality of, for example, three, circumferentially spaced tap holes 61 defined therein, each of which holes 61 is in the form of a blind hole extending halfway through the thickness of the ring shaped boss 51. On the other hand, as shown in FIG. 3, respective portions of the vertex wall 22 or the outermost area 8*b* of the air intake grille 8 are formed with a plurality of (three in this embodiment) screw insertion holes 62 shown by dotted lines, each extending completely through the thickness of the vertex wall 22, for receiving corresponding tap screw 63 therethrough. Accordingly, when the tapping screws 63 shown in FIG. 9 then loosely extending through the screw insertion holes 62 on the vertex wall 22 (FIG. 3) are fastened into the tap holes 61, the air intake grille 8 and the protective shroud 9A are connected together with the vertex wall 22 held in stable contact with the ring shaped boss 51 in a manner similar to that shown in FIG. 8.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention.

For example, although in any one of the foregoing embodiments of the present invention, the air intake grille 8 and the protective shroud 9 or 9A has been shown and described as respective members that are separate from each other, they may be integrally formed with each other by the use of any know molding technique. Integral molding of the air intake grille 8 and the protective shroud 9 or 9A is particularly advantageous in that the number of component parts used to assemble the air blower can be reduced. Further, as a drive unit the combustion engine E can be replaced with an electric motor.

Accordingly, such changes and modifications are, unless they depart from the scope of the present invention as delivered from the claims annexed hereto, to be construed as included therein.

What is claimed is:

1. A portable air blower which comprises:

a blower fan for producing an air current;

a drive unit for driving the blower fan;

a casing for covering at least the blower fan and having a side wall with an air intake opening defined therein; and a covering unit for covering the air intake opening;

wherein the covering unit comprises an air intake grille fitted to the casing and operable to permit air to pass therethrough into the air intake opening, but to block foreign matters, and a protective shroud held in overlapping relation with the air intake grille for covering the air intake grille on one side of the air intake grille opposite to the air intake opening, wherein the air intake grille includes a base held in contact with the casing and an outermost area substantially opposite to the base, which outermost area is positioned spaced a distance from a plane of the base with a circumferential edge of the outermost area positioned substantially radially inwardly of an outer peripheral edge of the protective shroud and the outermost area of the air intake grille has a flat vertex wall and is held in coaxial relation with a center of the air intake opening and the protective shroud has a boss held in contact with the flat vertex wall of the air intake grille.

2. The portable air blower as claimed in claim 1, further comprising a hinged support structure for supporting the air intake grille for pivotal movement between a protecting position, in which the air intake grille is in position to cover the air intake opening in the casing, and an open position, in which the air intake grille is clear of the air intake opening, and a fastener for locking the air intake grille in the protecting position.

3. The portable air blower as claimed in claim 1, wherein the protective shroud has front and rear portions opposite to each other and a center portion substantially intermediate between the front and rear portions and, when viewed from top, is smoothly depressed at the center portion in a direction inwardly of the front and rear portions thereof.

4. The portable air blower as claimed in claim 1, wherein the air intake grille is of a shape to converge from the base thereof towards the outermost area.

5. The portable air blower as claimed in claim 1, wherein the air intake grille and the protective shroud are respective members separate from each other and the protective shroud is removably connected with the air intake grille through a plurality of engagement pawls.

6. The portable air blower as claimed in claim 1, wherein the air intake grille and the protective shroud are respective members separate from each other and the protective shroud is removably connected with the air intake grille through a plurality of screw members.

7. The portable air blower as claimed in claim 1, wherein the protective shroud has a peripheral edge area having a chamfered portion formed on an outer surface of the peripheral edge area, the chamfered portion being inclined inwardly towards the outer peripheral edge of the protective shroud.

8. The portable air blower as claimed in claim 1 wherein the protective shroud blocks any air from flowing directly through the protective shroud wherein the blower fan is limited to drawing air from a space extending between the base of the air intake grille and the outer peripheral edge of the protective shroud to prevent operator clothing from interfering with air flow through the air intake grille.

9. The portable air blower as claimed in claim 8 wherein the protective shroud blocks any air from flowing through the protective shroud and the blower fan draws air into the air intake grille only from an offset space between the contact of the protective shroud boss with the flat vertex wall of the air intake grille and the base of the air intake grill.

10. The portable air blower as claimed in claim 1, wherein the protective shroud, when viewed in a lateral direction, has front and rear portions which protrude substantially radially outwardly from the air intake grille.

11. The portable air blower as claimed in claim 10, wherein the protective shroud, when viewed in a lateral direction, has a vertical length and a longitudinal length, the vertical length being smaller than the longitudinal length.

12. A portable air blower which comprises:

a blower fan for producing an air current;

a nozzle for directing the air current from the blower fan;

a drive unit for driving the blower fan about a rotational axis;

a casing for covering at least the blower fan and having a side wall with an air intake opening defined therein and aligned with the rotational axis;

an air intake grille connected to the side wall and extending across the air intake opening to enable air to directly flow parallel to the rotational axis into the blower fan; and a protective shroud, offset from and substantially covering the air intake grille opposite to the air intake opening, to provide a peripheral spaced opening between the air intake grille and the protective shroud to enable air to enter around the peripheral spaced opening and subsequently be directed by the air intake grille wherein the protective shroud prevents operator clothing from interfering with the air flow through the air intake grille, wherein the air intake grille is pivotally mounted to the side wall and spring biased to a closed position over the air intake opening.

13. The portable air blower as claimed in claim 12 wherein the protective shroud can be removably friction mounted on the air intake grille with a pawl member.

14. The portable air blower as claimed in claim 13 wherein the air intake grille has a circular perimeter and the protective shroud has an oval perimeter.

15. The portable air blower as claimed in claim 13 wherein the protective shroud and air intake grille are formed of a plastic material.

16. The portable air blower as claimed in claim 12, wherein the protective shroud has front and rear portions opposite to each other and a center portion substantially intermediate between the front and rear portions and, when viewed from top, is smoothly depressed at the center portion in a direction inwardly of the front and rear portions thereof.

17. The portable air blower as claimed in claim 12, wherein the air intake grille is of a shape to converge from the base thereof towards an outermost area.

18. The portable air blower as claimed in claim 12, wherein an outermost area of the air intake grille has a flat vertex wall and is held in a coaxial relation with a center of the air intake opening and the protective shroud has a boss held in contact with the flat vertex wall of the air intake grille.

19. The portable air blower as claimed in claim 18, wherein the protective shroud has a peripheral edge area having a chamfered portion formed on an outer surface of the peripheral edge area, the chamfered portion being inclined inwardly towards the outer peripheral edge of the protective shroud.

20. A portable air blower which comprises:

a blower fan;

a drive unit for driving the blower fan;

a casing for covering at least the blower fan and having a side wall with an air intake opening defined therein;

an air intake grille for covering the air intake opening and having a base, which is held in contact with the casing, and an outermost area substantially opposite to the base; and a protective shroud fitted to an outer area of the air intake grille and having front and rear portions opposite to each other and a center portion substantially intermediate between the front and rear portions;

wherein the air intake grille is of a shape to converge from the base thereof towards the outermost area with the outermost area positioned spaced a distance from a plane of the base; and wherein the protective shroud, when viewed from top, is smoothly depressed at the center portion in a direction inwardly of the front and rear portions thereof, wherein the outermost area of the air intake grille has a flat vertex wall and is held in coaxial relation with a center of the air intake opening and the protective shroud has a boss held in contact with the flat vertex wall of the air intake grille.

* * * * *